US007001096B2

(12) United States Patent
With

(10) Patent No.: US 7,001,096 B2
(45) Date of Patent: Feb. 21, 2006

(54) PAPER BINDER

(75) Inventor: Jere L. With, 6666 Caminito Sinnecock, La Jolla, CA (US) 92037

(73) Assignee: Jere L. With, La Jolla, CA (US)

( * ) Notice: Subject to any disclaimer, the term of this patent is extended or adjusted under 35 U.S.C. 154(b) by 0 days.

(21) Appl. No.: 10/845,578

(22) Filed: May 12, 2004

(65) Prior Publication Data

US 2005/0008426 A1 Jan. 13, 2005

Related U.S. Application Data

(63) Continuation of application No. 09/583,620, filed on May 31, 2000, now Pat. No. 6,736,563.

(51) Int. Cl.
*B42F 13/12* (2006.01)

(52) U.S. Cl. ..... 402/60; 402/62; 402/63; 402/64; 402/68

(58) Field of Classification Search ..... 402/60, 402/62, 64, 67, 68, 69, 63
See application file for complete search history.

(56) References Cited

U.S. PATENT DOCUMENTS 944,179 A * 12/1909 Crump ..... 402/2
3,572,867 A 3/1971 Cooper
4,453,850 A 6/1984 Purcocks
4,529,226 A 7/1985 Weinman
4,579,472 A 4/1986 Andrews
5,102,252 A * 4/1992 Chu ..... 402/4
5,197,762 A 3/1993 Abramov
5,320,456 A * 6/1994 With ..... 402/64
5,653,544 A * 8/1997 Cabre Pijoan et al. ..... 402/64
5,690,443 A * 11/1997 Sullivan ..... 402/63

OTHER PUBLICATIONS

Vita Presentation Concepts, Inc. mailed flyer for the VPC.TM. Tape Binding System, marked "Received Oct. 28, 1998.".
The Corby Group catalog, pp. 22 and 23 for plastic binding systems, velobinding and thermal binding, undated.
Spiral Binding Company, Inc., catalog, pp. 2-4 and 10-12 (2000).

* cited by examiner

*Primary Examiner*—Willmon Fridie, Jr.
(74) *Attorney, Agent, or Firm*—Fulwider Patton LLP

(57) ABSTRACT

An apparatus for binding a stack of paper with at least one hole defined therein. The apparatus includes a male element having at least one post with a plurality of teeth. The post is configured to receive the stack of paper by threading the post through the hole. A female element with at least one aperture defined therein is placed substantially over the male element. The female aperture is structured to releasably engage at least one of the plurality of post teeth with sufficient grip to bind the stack of paper together.

13 Claims, 3 Drawing Sheets

PAPER BINDER

This application is a continuation of U.S. application Ser. No. 09/583,620, filed May 31, 2000, now U.S. Pat. No. 6,736,563.

BACKGROUND OF THE INVENTION

1. Field of the Invention

The present invention generally relates to an apparatus for binding multiple sheets of paper. More particularly, the invention concerns a ratchet mechanism that binds hole-punched paper.

2. Discussion of the Related Art

Considerable effort has been expended toward devices for binding together sheets of paper. Most of them have not focused on reducing the effort and time, and/or improving the convenience in binding paper. Many prior art devices require that the paper to be bound be specially notched or punched using specialized equipment. Other devices have a finite paper capacity that either restricts the bind to a maximum number of sheets or, if the maximum capacity is not met, whatever pages are bound have free play within the device rather than snugly conforming to the paper to be bound. Still other binding devices require the paper be meticulously threaded with either straps, strips, arms, wire, or cables.

Prior art mechanical binding devices generally have one or more of the following drawbacks: the paper must be specially punched; the mechanism is relatively complex; the device doesn't conform to the paper bound; the use of adhesives, heat, or tape is required; the device may be relatively expensive to make or be made from expensive materials, such as metal; the device adds unnecessary weight and inhibits portability; and the process may require electrically powered equipment which adds to the cost as well as restricts where the bending may be done.

SUMMARY OF THE INVENTION

The present invention solves the above-described problems of binding hole-punched paper. Broadly, the present invention provides a simple, compact and economical method to bind a wide range of hole-punched sheets of paper arranged in a stack. As used herein, a stack refers to a plurality of sheets of hole-punched paper with the holes substantially aligned. The edges of the paper may align, but this is not necessary.

More specifically, one embodiment of the invention comprises an apparatus for binding a stack of paper with at least one hole defined therein. The device includes a male element comprising at least one post having a plurality of teeth, the post configured to receive the stack of paper by inserting the post through the hole. A female element or clamping member with at least one aperture defined therein is placed over the male element, with the female aperture structured to releasably engage at least one (1) of the plurality of post teeth with sufficient grip to bind the stack of paper together.

BRIEF DESCRIPTION OF THE DRAWING

The nature, goals, and advantages of the invention will become more apparent to those skilled in the art after considering the following detailed description when read in connection with the accompanying drawing—illustrating by way of examples the principles of the invention—in which like reference numerals identify like elements throughout wherein.

DETAILED DESCRIPTION OF THE PREFERRED EMBODIMENTS

General

In the following paragraphs, the present invention will be described in detail by way of example with reference to the attached drawings. Throughout this description, the preferred embodiment and examples shown should be considered as exemplars, rather than as limitations on the present invention.

Structure

Figure 1:
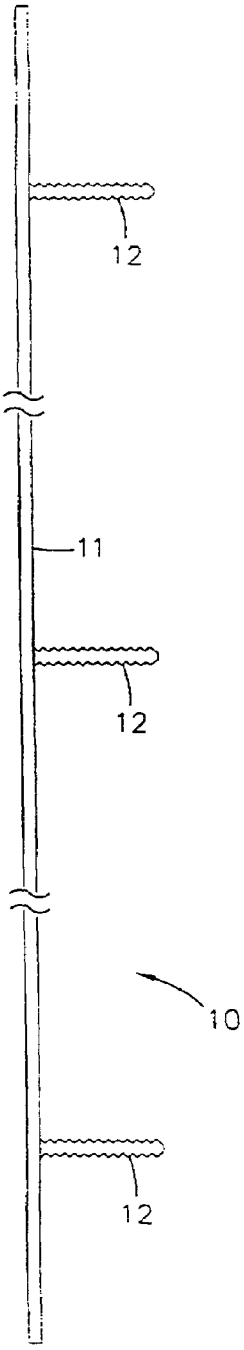
FIG. 1 is a side view of the base member of a preferred embodiment of the present invention.
Figure 2:
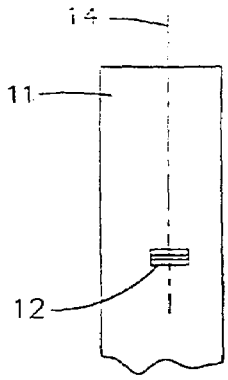
FIG. 2 is a top view of a section of the base member of FIG. 1.

Referring now to FIGS. 1 and 2, base member 10 is comprised of an elongated bar 11 having one or more posts or stakes 12 extending substantially perpendicularly from the elongated bar. A preferred embodiment base member has three posts extending from the elongated bar.

Elongated bar 11, in a preferred embodiment, is dimensioned lengthwise according to the size of the paper to be bound. Accordingly, if standard 8½"×11" size sheets are to be bound, the elongated bar would be dimensioned about 11" in length. Of course, it should be evident to those skilled in the art that larger or smaller paper sheets, such as "A4" paper, could be accommodated by merely changing the length of the elongated bar. It should also be evident the orientation of the paper may be changed so that the narrower dimension is bound, as in a standard two-hole arrangement.

Figure 3:
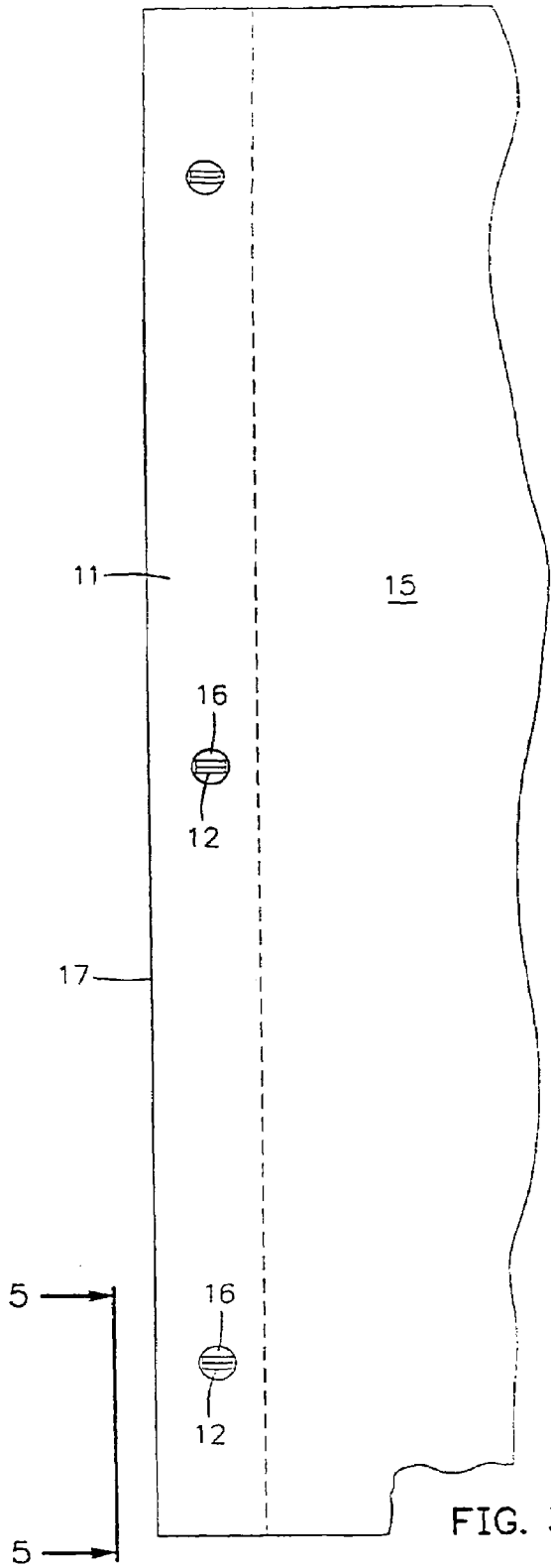
FIG. 3 is a top view of the base member of FIG. 1, with a piece of paper positioned over the base member.

As shown in FIGS. 1–3 and 5, the base member 10 includes at least one post or stake 12 that extends substantially perpendicularly from the elongated bar 11. A preferred embodiment base member has three posts, but the number of posts can vary, depending upon the number of paper holes 16 found in paper 15. Each post has as a plurality of teeth or ratchet flanges 13, shown in detail in FIG. 5. One embodiment or the base member arranges the posts so that they are somewhat offset from the longitudinal centerline 14 of the base member, as shown in FIGS. 2 and 3. Referring to FIG. 3, the offset arrangement of the posts 12 ensures that the section of paper 15 that is adjacent to paper hole 16 is supported and protected by elongated bar 11 (shown in phantom). That is, in a preferred embodiment, the elongated bar extends substantially along the entire length of the paper adjacent the paper holes 16, and the elongated bar also extends substantially to paper edge 17 adjacent to the paper holes. Alternative embodiments of elongated bar 11 can be configured to either extend beyond the paper edges or the elongated bar can be configured so that it does not extend to the edges of the paper, depending upon the application.

Preferably, base member 10, that includes elongated bar 11 and post 12, is an integral element requiring only one material. In a preferred embodiment the base member is made of a high strength plastic such as vinyls, polymers, polypropylenes or polyethylenes. The one piece construction of the base member using a non-metallic material has the advantage of reducing manufacturing cost. Moreover, the configuration is simple and therefore easy to mold, further reducing costs.

Figure 4:
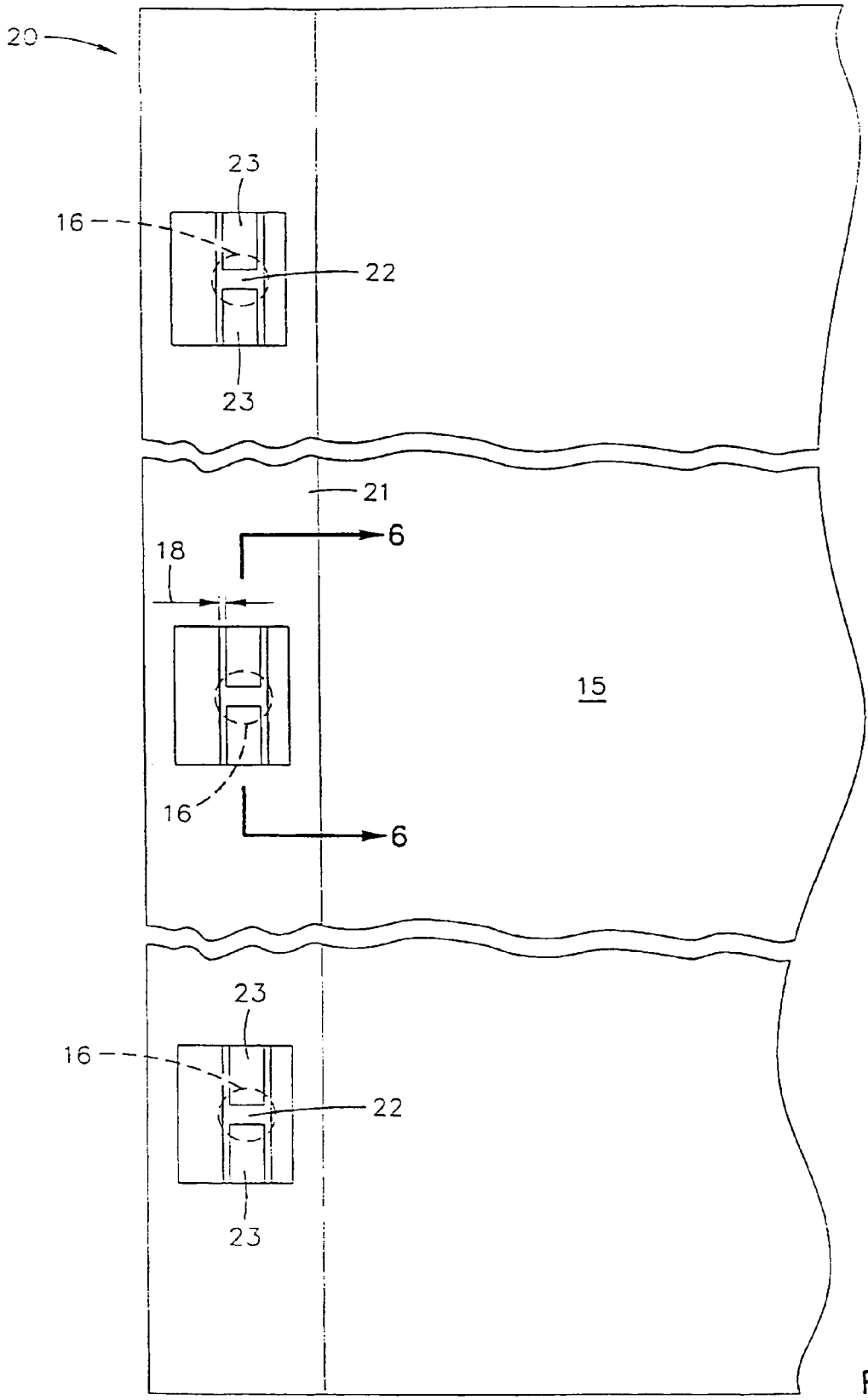
FIG. 4 is a top view of the clamping member of a preferred embodiment of the present invention.
Figure 5:
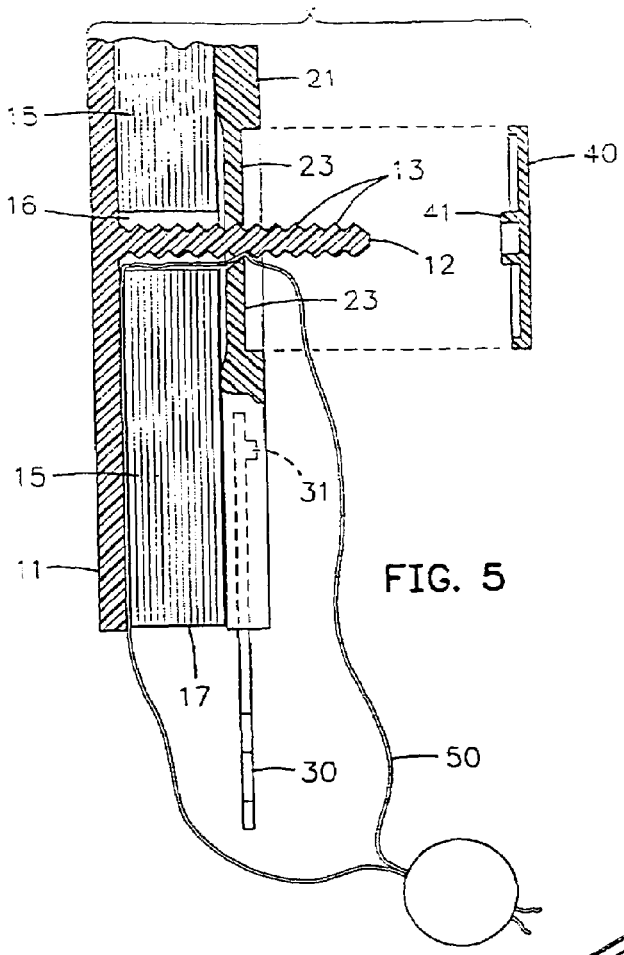
FIG. 5 is a sectional view showing the base member post teeth in operative engagement with the clamping member with a multiplicity of sheets of paper positioned therebetween.

Referring now to FIGS. 4 and 5, clamping member or keeper 20 is preferably a one piece design comprising an elongated body 21 and at least one post-receiving aperture or post-hole 22. Elongated body 21, in a preferred embodiment, is dimensioned lengthwise according to the size of the paper to be bound. Accordingly, if standard 8½"×11" size sheets are to be bound, the elongated body would be dimensioned about 11" in length. Of course, it should be evident to those skilled in the art that larger or smaller paper sheets, such as "A4" paper, could be accommodated by merely changing the length of the elongated body. It should also be evident the orientation of the paper may be changed so that the narrower dimension is bound, as in a standard two-hole arrangement.

Figure 6:
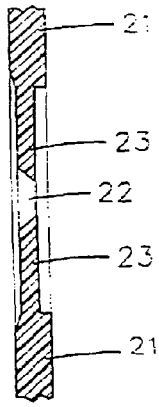
FIG. 6 is a sectional view taken along cutting plane 6—6 of FIG. 4.

A preferred embodiment keeper has three post-holes, but the number of post-holes can vary, depending upon the number of posts 12 employed by base member 10. Each post-hole is comprised of two tongues or tabs 23 that extend from keeper 20 in a somewhat cantilevered configuration, shown in FIG. 6. Due to its cantilevered configuration, each tongue will elastically deform when a load is applied.

As shown in FIG. 4, one embodiment of keeper 20 arranges the post-holes so that they are somewhat offset from the longitudinal axis of the keeper, similar to posts 12 on base member 10. The offset arrangement of the post-holes ensures that the section of paper 15 that is adjacent to paper hole 16 is supported and protected by the elongated body 21. That is, in a preferred embodiment, the elongated body extends substantially along the entire length of the paper adjacent the paper holes 16, and the elongated body also extends substantially to paper edge 17 adjacent to the paper holes. Alternative embodiments of elongated body 21 can be configured to either extend beyond the paper edges or the elongated body can be configured so that it does not extend to the edges of the paper, depending upon the application.

Preferably, keeper 20 is a single body piece design requiring only one material. In a preferred embodiment the keeper is made of a high strength malleable plastic such as vinyl, polypropylene or polyethylene. The one piece construction of the keeper using a non-metallic material has the advantage of reducing cost in manufacturing. Moreover, the geometry is simple and therefore easy to mold, further reducing costs.

Figure 7:
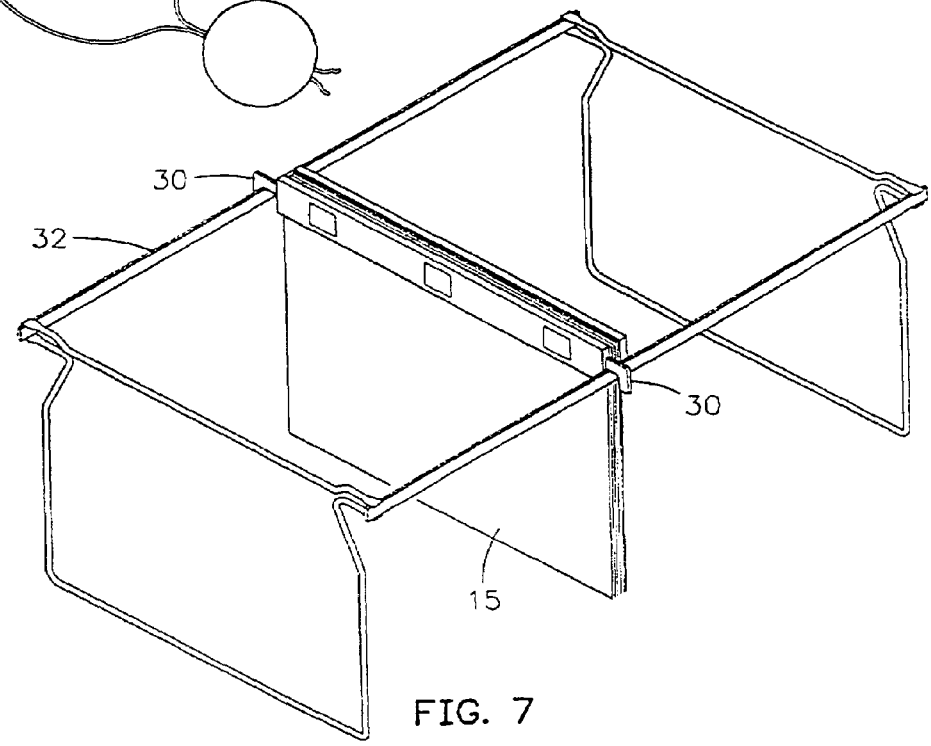
FIG. 7 shows the assembled present invention hanging in a file holder frame.

Referring to FIGS. 5 and 7, a hook element, or hanger 30 can be detachably coupled to an end portion of either the elongated bar 11, or the elongated body 21. As shown in the embodiment of FIG. 5, the hanger is attached to the elongated body by a tab, or small relief 31 (shown in phantom). The hanger 30 fits into a recess formed in the elongated body, and is thereby engaged between the elongated body 21 and the paper 15. FIG. 7 shows the hanger in use, enabling a user to hang a bound document in a "Pendaflex" type file holder frame 32. Accordingly, when the hanger is employed, the paper binder of the present invention can be used in standard filing cabinets or drawers.

Operation

FIG. 5 shows a cross-sectional side view of the present invention binding a stack of paper 15. In operation, a stack of paper 15 is placed on top of base member 10, so that one or more posts 12 protrude through corresponding paper hole(s) 16. Each post has ratchet teeth 13. The keeper 20 is then fitted over the stack of paper and a downward pressing force on the keeper causes tongues 23 in post-holes 22 to firmly engage the post ratchet teeth 13 as the keeper is pressed against the stack of paper. Note that the end of each tongue 23 may be beveled to make each tongue sharper for more positive engagement with teeth 13. Thus, each tongue 23 is capable of engaging at least one tooth of ratchet teeth 13 when a downward load is applied on the keeper. The secure engagement between the ratchet teeth and post-hole tongues generates sufficient grip to bind the stack of paper firmly together.

Additionally, since the keeper and the base member are small the device has the further advantage of being portable and self contained and is easily applied when and where needed. No further component of machinery is necessary to bind a stack of paper firmly together.

The binding action of tongues 23 can serve to bind the papers permanently because the ratchet operation provides for a very strong and stable device. However, should there be a need to re-bind the sheets (for example to add sheets that were inadvertently left out) the binding device may be easily removed and the sheets bound again. In this manner a wide range of paper amounts can be easily bound. Documents that are incomplete or "working" documents can be temporarily bound. When the document is complete the posts 12 that extend beyond the ratchet teeth 13 can be broken off for a more cosmetic and secure arrangement.

As shown in FIG. 5, a cap, or cover 40 can be placed over post holes 22. When placed over the post-holes, cap pins 41 engage ratchet teeth 13. The caps improve the cosmetic appearance of the device by covering the posts and ratchet teeth. Moreover, the keeper 20 and base member are securely locked together, thus making it difficult to remove individual pieces of paper from the paper stack without damaging the posts 12. This arrangement can be employed when the integrity of the paper stack must be maintained. Alternatively, a small amount of the glue can be placed between the post and the ratchet teeth securely locking the keeper and base member together.

An alternative method to ensure the security or integrity of the paper stack is also shown in FIG. 5. Wire 50 can be placed adjacent to post 12 when the paper 15 and keeper 20 are placed over the post. The wire can be threaded through gap 18 (shown in FIG. 4) between the keeper and the tongues. The wire can then be formed into a loop and tied or otherwise securely bound so that the removal of an individual piece of paper from the bound paper stack would require cutting or tampering of the wire.

Other Embodiments

Certain preferred embodiments have been described above. It is to be understood that a latitude of modification and substitution is intended in the foregoing disclosure, and that these modifications and substitutions are within the literal scope—or are equivalent to—the claims that follow.

Accordingly, it is appropriate that the following claims be construed broadly and in a manner consistent with the spirit and scope of the invention herein described.

What is claimed is:

1. An apparatus for binding a stack of paper with at least one hole defined therein, comprising:

a male element comprising at least one post having a plurality of teeth, a groove formed by a pair of adjacent teeth, the post configured to receive the stack of paper by inserting the post through the hole; and a planar female element with at least one aperture defined therein and having a first thickness, the planar female element including one or more pairs of corresponding, opposed planar tongues extending into the aperture, the planar tongues having a second thickness which is less than the first thickness, with the aperture structured to accommodate a post of the male element and releasably grip the groove formed by two teeth of the male element with sufficient grip to bind the stack of paper together.

2. The apparatus of claim 1, wherein the male element comprises an elongated and substantially flat body structured to support an edge of the stack of paper, with the at least one post extending substantially perpendicularly from the flat body.

3. The apparatus of claim 2, wherein the substantially flat body includes a longitudinal axis and the at least one post is offset from the longitudinal axis.

4. The apparatus of claim 1, wherein the female element comprises an elongated and substantially flat body structured to support an edge of the stack of paper.

5. The apparatus of claim 4, wherein the substantially flat body includes a longitudinal axis and the at least one aperture is offset from the longitudinal axis.

6. The apparatus of claim 1, wherein the tongues are structured to ratchetably engage at least some of the plurality of teeth.

7. The apparatus of claim 1, wherein the male element comprises two posts and the female element comprises two apertures.

8. The apparatus of claim 1, wherein the male element comprises three posts and the female element comprises three apertures.

9. The apparatus of claim 1, further comprising a hook element detachably coupled to an end of one of the male element and the female element which enables the apparatus to hang from a frame.

10. The apparatus of claim 1, wherein the male element and the female element are comprised of a material selected from the group consisting of plastics, vinyls, polystyrenes and polypropylene.

11. The apparatus of claim 1, further comprising at least one cap structured to detachably fit over the at least one aperture.

12. The apparatus of claim 1, further comprising at least one cap structured to lockingly engage the at least one aperture, thereby locking the female element and the male element together.

13. The apparatus of claim 1, further comprising at least one strand configured to permanently lock the female element and the male element together.

* * * * *

UNITED STATES PATENT AND TRADEMARK OFFICE

CERTIFICATE OF CORRECTION

PATENT NO. : 7,001,096 B2
APPLICATION NO. : 10/845578
DATED : February 21, 2006
INVENTOR(S) : Jere L. With It is certified that error appears in the above-identified patent and that said Letters Patent is hereby corrected as shown below:

Column 2,
Line 56, delete "or" and insert --of--.

Signed and Sealed this

Eighteenth Day of July, 2006

JON W. DUDAS
*Director of the United States Patent and Trademark Office*